US005793930A

United States Patent [19]

Moulsley

[11] Patent Number: 5,793,930

[45] Date of Patent: Aug. 11, 1998

[54] ANALOGUE SIGNAL CODER

[75] Inventor: Timothy J. Moulsley, Caterham, England

[73] Assignee: U.S. Philips Corporation, New York, N.Y.

[21] Appl. No.: 426,291

[22] Filed: Apr. 20, 1995

[30] Foreign Application Priority Data

Apr. 22, 1994 [GB] United Kingdom ..... 9408037

[51] Int. Cl.[6] ..... G10L 7/02

[52] U.S. Cl. ..... 395/2.28; 395/2.1; 395/2.16; 395/2.32

[58] Field of Search ..... 395/2.09, 2.2, 395/2.1, 2.14, 2.16, 2.18, 2.26, 2.28, 2.29, 2.32

[56] References Cited

U.S. PATENT DOCUMENTS 5,371,853 12/1994 Kao et al. ..... 395/2.32

FOREIGN PATENT DOCUMENTS 9103790 6/1990 WIPO .

9103790 3/1991 WIPO .

OTHER PUBLICATIONS

Kleijn, W. B. "Encoding Speech Using Prototype Waveforms," IEE Transactions on Speech and Audio Processing, vol. 1, No. 4, Oct. 1993.

"Code Excited Linear Prediction (CELP): High-Quality Speech at Very Low Bit Rates" by M.R. Schroeder and B.S. Atal, ICASSP 1985 pp. 937–940.

*Primary Examiner*—Allen R. MacDonald
*Assistant Examiner*—Alphonso A. Collins
*Attorney, Agent, or Firm*—Arthur G. Schaier

[57] ABSTRACT

An analogue signal coder including circuitry for digitizing the analogue signal, deriving a long term correlation coefficient for the analogue signal and for deriving a number of short term coefficients. The coder also includes circuitry for deriving an excitation sequence which can be used to synthesize an approximation to the analogue signal. The circuitry for deriving a long term coefficient derives a plurality of sums of products of samples of the digitized signal and interpolates the sums of products. The long term correlation coefficient is derived from the interpolated plurality of sums of products with fractional resolution and reduced computational complexity.

12 Claims, 1 Drawing Sheet

ANALOGUE SIGNAL CODER

BACKGROUND OF THE INVENTION

1. Field of the Invention

The present invention relates to an analogue signal coder, having particular, but not exclusive, application to a speech codec for use in digital radio systems. The invention further relates to a long term filter for use in such a coder and to the method of prediction filtering used by this filter.

2. Discussion of the Related Art

Low bit-rate analogue signal coding is becoming more and more important, particularly with the introduction of digital private mobile radio and digital cellular telephones to make better use of limited frequency spectrum. However, there has to be a compromise between speech quality, bit-rate and coder complexity. To obtain good quality speech at low bit-rates usually requires a complex speech coder having a heavy computational load. There is constant pressure to lower this computational load in order to reduce both the cost and the power consumption of mobile radio units.

One family of low bit-rate speech coders utilise a long term predictor to allow the coding of the pitch related redundancy in the source signal and this can be a significant contributor to the complexity of the coder. One type of analogue signal coding which employs such pitch prediction is Code Excited Linear Prediction or CELP. CELP is introduced in 'Code Excited Linear Prediction (CELP): High Quality Speech at Very Low Bit Rates' by B. S.Atal and M.R.Schroeder in the Proceedings of the International Conference on Acoustics, Speech and Signal Processing (ICASSP) 1985. Incoming speech is coded as an index to a sequence in a stochastic codebook (which is provided to both coder and decoder), as long term (or pitch-related) and short term (or spectral envelope) prediction coefficients together with some parameters including gain values. In order to reduce the coded bit-rate and the complexity of the coder, the long term prediction filter is usually a single tap device although larger numbers of taps (notably three) have been used. Typical values of the delay required of a long term prediction filter in a speech coder are between 2 and 20 milliseconds, corresponding to pitches of between 500 and 50Hz.

As has been observed in International Patent Application No. WO 91/03790, the speech to be coded is sampled at around 8 kHz so the period of a high pitched voice signal can correspond to just 16 sample periods. If integer values of sample period are used to define the long term predictor (LTP) delay then the resolution is poor. This quantisation inaccuracy can cause quite severe distortion in the resynthesis of coded high pitched speech. The aforementioned Patent Application describes a solution to this problem which upsamples the speech signal using interpolation filtering to effectively reduce the quantisation error in the long term prediction. The search for the optimum long term delay is then analogous to that of the prior art (integer resolution) arrangement but at a higher resolution. Unfortunately the search for the optimum delay becomes more computationally intensive in proportion to the increase in long term prediction accuracy obtained.

SUMMARY OF THE INVENTION

It is an object of the present invention to provide a speech coder having enhanced long term predictor resolution but which suffers less of a computational load penalty.

According to one aspect of the present invention there is provided a coding arrangement for an analogue signal, comprising means for digitising the analogue signal, means for deriving a long term correlation coefficient for the analogue signal, means for deriving a number of short term coefficients for the analogue signal and means for deriving an excitation sequence which can be used to synthesise an approximation to the analogue signal, characterised in that the means for deriving a long term coefficient comprises means for deriving a plurality of sums of products of samples of the digitised signal, means for interpolating the sums of products and means for determining a long term correlation coefficient from the interpolated plurality of sums of products of samples.

The present invention is based upon the realisation that the computational load imposed by an interpolating long term prediction filter in a signal coder can be substantially reduced (typically by one half) if the interpolation filtering is carried out upon a set of sums of products of digitised signals rather than upon the sample values (either direct from the source or after spectral envelope filtering). The digitised signal may comprise, at least in part, some previously coded speech samples. This is most likely to occur in a closed loop determination of LTP delays where the previously coded speech samples are used to derive the LTP delay coefficient. Since the re-synthesizer has access to the previously coded samples and not, of course, the original speech, this gives better quality resynthesised speech.

The selection of long term filter coefficient in a CELP speech coder, for example, can be carried out by maximisation of a square of a product between samples separated by a time delay, divided by a term relating to the amplitude of the sample values (often an approximation is used). The technique in accordance with the present invention may advantageously be applied to either or both the numerator and/or denominator in this division process.

According to a second aspect of the present invention there is provided a prediction filtering arrangement comprising means for storing a plurality of samples, means for deriving a plurality of sums of products for the plurality of samples, means for interpolating the sums of products and means for determining a long term correlation coefficient from the interpolated plurality of sums of products of samples.

BRIEF DESCRIPTION OF THE DRAWINGS

The present invention will now be described, by way of example, with reference to the accompanying drawings, in which.

DETAILED DESCRIPTION OF THE PREFERRED EMBODIMENTS

Figure 1:
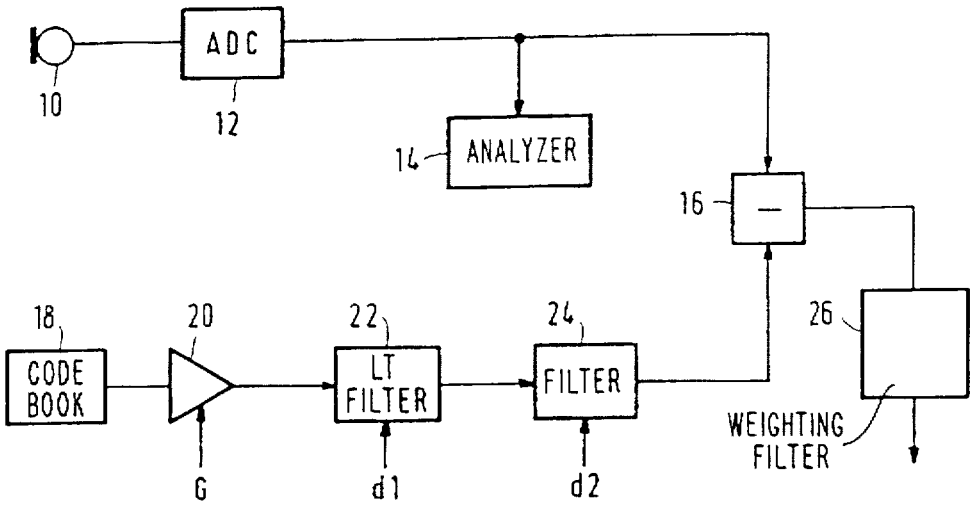
FIG. 1 is a block schematic diagram of a known CELP coder to which the present invention may be applied.

The speech coder in FIG. 1 comprises a microphone 10 whose output is digitised in an analogue to digital converter (ADC) 12 to provide a series of digitised speech samples to a coefficient analyzer 14 and to a comparator shown as subtractor 16. A codebook 18 contains a number of stochastic sequences which are read out in sequence to an amplifier 20 having a gain parameter G provided by the coefficient analyser 14. The output of the amplifier 20 is fed to a long term filter 22 having a delay parameter dl also provided by the coefficient analyser 14. The output of the filter 22 is fed to a filter 24 which is supplied with a number of coefficients d2 by the coefficient analyser 14. The output of the filter 24 is fed to the comparator 16 which gives an output corresponding to the difference between its two inputs to a weighting filter 26 whose output is analysed for perceptual closeness of match between the waveform from the ADC 12 and the filter 24. A further filter may be provided in cascade with the ADC 12 to filter the incoming speech signal in known manner.

In operation, a sequence from the codebook 18 is amplified and filtered in accordance with the characteristics determined from the incoming speech signal with which the filtered sequence is then compared. Once the sequence in the codebook 18 which gives the closest perceptual match (the filter 26 is intended to approximate the perception of human hearing has been determined, a coded version of the incoming speech can be provided. The coded version comprises a codebook sequence index, long and short term filter coefficients and a gain term. The speech may then be stored or transmitted at very low bit-rates. The speech may be recreated from memory or at a receiver using the same codebook sequence and filter parameters as were used at the coder. As discussed above one source of poor quality re-synthesised speech is the long term filter 22 as a result of limited temporal resolution provided by the sample rate of the system. While an open loop arrangement is shown the present invention is equally applicable to a closed loop LTP predictor which derives the LTP delay from past coded samples.

Improved resolution in the long term filter has been proposed but the known system uses an interpolation filter to upsample the incoming speech waveform, thus providing what is effectively a higher resolution source signal. The analysis of this up-sampled signal then proceeds in an analogous way to that of integer period analysis albeit at a higher rate. The computational overhead however is large since both the upsampling and the greater resolution long term prediction require extra computing power.

Figure 2:
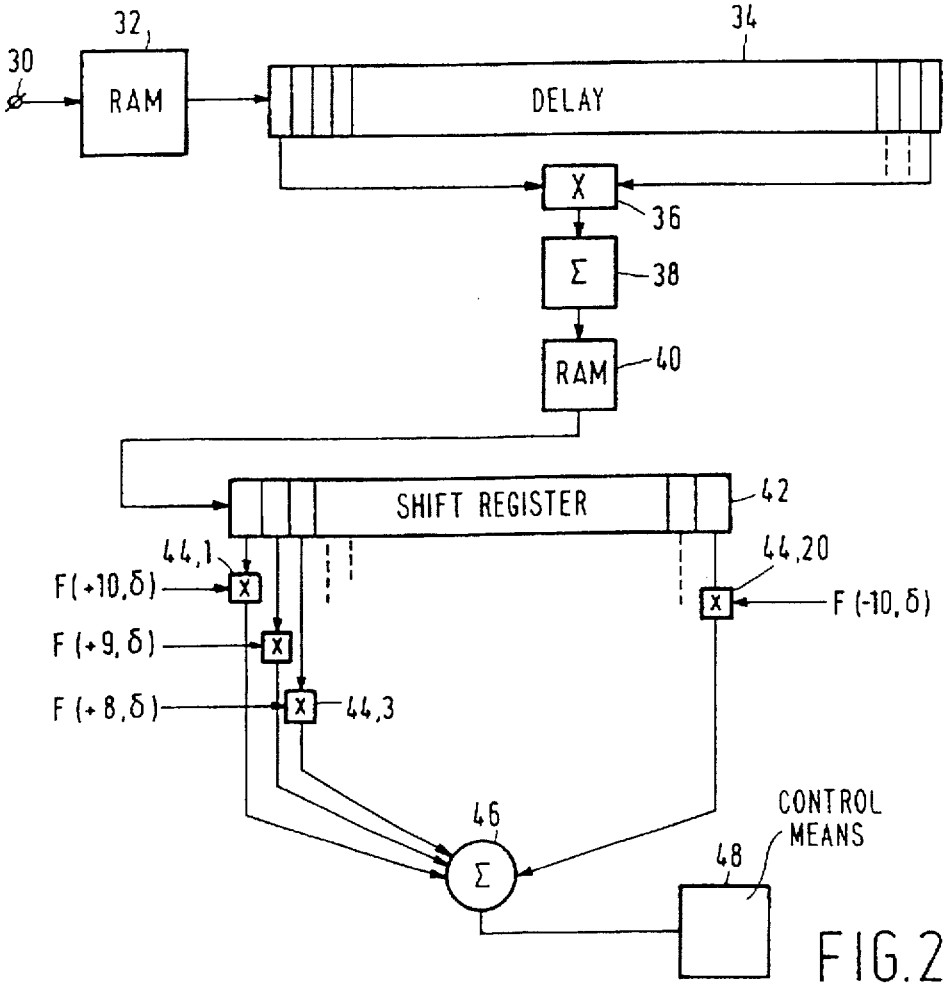
FIG. 2 shows a block schematic diagram of a long term predictor in accordance with the present invention.

A long term predictor in accordance with the present invention is shown in FIG. 2. The sampled signal applied to the coefficient analyser of FIG. 1 is indicated by a bus 30 which signal is stored in a Random Access Memory (RAM) 32. An output of the RAM 32 (which in practice will comprise the data bus of the RAM under read rather than write control) is fed to a delay 34 which holds a value of RAM output while the contents of another RAM location is retrieved. Once the contents of the second address are retrieved the two can be multiplied by the multiplier 36. The multiplier inputs can be fed values retrieved from any part of the RAM 32. An output of the multiplier 36 is fed to an accumulator 38 whose output is fed to a further RAM 40. The RAM 40 is shown coupled to a shift register 42 for ease of description which shift register comprises 20 stages. Each of the stages of the shift register 42 is connected to a first input of a multiplier 44.1 to 44.20 (only some shown for clarity), which multipliers each have a second input to which is supplied an interpolation filter coefficient and the outputs of the multipliers 44.1 to 44.20 are accumulated in a summer 46. The combination of the shift register 42, multipliers 44.1 to 44.20 and the summer 46 form an interpolation filter. Control means 48 are connected to the output of the summer 46 to retain the maximum value as will be described below. The interpolation filtering may conveniently be carried out by a sinc function, (sin x)/x as is known from, for example, 'DFT/FFT and convolution algorithms' by C. S. Burrus and T. W. Parks, John Wiley 1985.

In operation,a number of pairs of speech samples are read from the RAM 32, multiplied and accumulated to provide a plurality of sums of products of the incoming signal at different time delays. These sums are then stored for feeding through the interpolation filter 42, 44, 46 to enable the interpolation to be carried out. By interpolating sums of products of the incoming signal to derive the long term predictor coefficient a considerable saving in computational overhead can be realised over a system which interpolates the incoming speech samples directly.

In the following examples of long term predictor delay determination,the following assumptions apply.

The optimum LTP delay N can be determined by maximising the (integer) delay i, the LTP delay in the following (integer) equation:

$$N=\text{value of } i \text{ giving max } (\Sigma d(k+i).d(k))^2/\Sigma d(k+i)^2 \quad [1]$$

in which: d(k) is a filtered version of the speech signal k is the (integer) sample index In other words N is the maximum value of multiplying samples from the signal at a separation of i samples divided by a term representative of the amplitude of the incoming signal. The summations are carried out for values of k corresponding to the time interval being analysed. A typical value is 80 speech samples although any number of this order is suitable.

The numerator (num) and denominator (den) terms can be written as:

$$\text{num}(i)=\Sigma d(k+i).d(k) \quad [2]$$

$$\text{den}(i)=\Sigma d(k+i)^2 \quad [3]$$

and the value of N is equal to value of i maximising $\text{num}(i)^2/\text{den}(i)$.

The technique is extended to fractional delays by adding a fractional term δ to the integer delay i, thus:

$$\text{num}\ (i\delta)=\Sigma d(k+i+\delta).d(k) \quad [4]$$

$$\text{den}\ (i\delta)=\Sigma d(k+i+\delta)^2 \quad [5]$$

and the value of i+δ which maximises $\text{num}(i+\delta)^2/\text{den}(i+\delta)$ can be derived.

The prior art approach to improved resolution thus replaces i with a term (i+δ) where δ is a fractional sample delay and the relevant sample is determined using known interpolation techniques. The required interpolation may be carried out using a sinc function F:

$$d(k+i+\delta)=\Sigma F(j,\delta).d(k+j) \quad [6]$$

where F(j,δ) are interpolation filter coefficients and a typical range of summation would be j=−10 to j=+10.

The new approach in accordance with the present invention, however generates approximations to num and den as follows:

$$\text{num}'(i+\delta)=\Sigma F(j,\delta).\text{num}(i+j) \quad [7]$$

$$\text{den}'(i+\delta)=\Sigma F(j,\delta).\text{den}(i+j) \quad [8]$$

using the same filter coefficients and the same interpolation parameters. This technique is valid for bandlimited signals sampled at the Nyquist rate and in low bit-rate speech coding and most other applications this criterion is satisfied. There is a need to store the intermediate values of num(i) and den(i) but this require s only a modest amount of memory.

The reduction in complexity of the new technique when compared with the prior art fractional delay technique is now illustrated by two examples. In the first:

| | |
|---|---|
| Speech sample block size | 80 samples |
| Range of delay values | 20 to 147 |
| Fractional delay interval | ⅛ |
| Interpolation filter coefficients | 20 |
| Sample rate | 8 kHz |

To evaluate the LTP coefficient using interpolation of the speech samples directly would require:

Eqn. |4| to be evaluated 8×128 times, requiring 8×128×80 operations=81920 op

Eqn. |5| to be evaluated 8×128 times, requiring 8×128×80 operations=81920 op Eqn. |6| to be evaluated 8×80 times, requiring 8×80×20 operations=12800 op where op is an abbreviation for operations and which results in 17.664 million operations per second (MOPS) by summing the above operations and multiplying by 100, i.e the number of blocks per second.

Using the sum of cross products technique would require:

Eqn. |2| to be evaluated 148 times, requiring 148×80 operations=11840 op

Eqn. |3| to be evaluated 148 times, requiring 148×80 operations=11840 op

Eqn. |7| to be evaluated 8×128 times, requiring 8×128×20 operations=20480 op

Eqn. |8| to be evaluated 8×128 times, requiring 8×128×20 operations=20480 op giving a total of 6.464 MOPS when the above operations are summed and multiplied by 100, which is a reduction by a factor of almost three over the prior art technique.

The second example uses some simplification techniques which are already known for CELP coding systems. The denominator term of the equation for optimising the LTP delay is calculated recursively and this results in such a low computational overhead that it will be neglected from the analysis. This is known to generate a sufficiently accurate approximation to the denominator term. In addition, fractional LTP delay values are only calculated over part of the delay range, and not necessarily with the maximum resolution for all lags.

The parameters are:

| | |
|---|---|
| Speech sample block size | 80 samples |
| Range of integer delay values | 20 to 147 |
| Number of fractional delay values | 128 |
| Minimum rational delay interval | ⅛ |
| Interpolation filter coefficients | 20 |
| Sample rate | 8 kHz |

To evaluate the LTP coefficient using interpolation of the speech samples directly would require:

Eqn. |2| to be evaluated 128 times, requiring 128×80 operations=10240 op

Eqn. |4| to be evaluated 128 times, requiring 128×80 operations=10240 op

Eqn. |6| to be evaluated 8×80 times, requiring 8×80×20 operations=12800 op giving a total of 3.328 MOPS when summed and multiplied by 100.

Using the sum of cross products technique would require:

Eqn. |2| to be evaluated 148 times, requiring 148×80 operations=11840 op

Eqn. |7| to be evaluated 128 times, requiring 128×20 operations=2560 op

Eqn. |8| to be evaluated 128 times, requiring 128×20 operations=2560 op giving a total of 1.696 MOPS when summed and multiplied by 100, which is a reduction by a factor of approximately two over the prior art technique. The relative reduction in computational complexity over the prior art technique is less pronounced in this case because the more selective use of interpolation means that less overall interpolation is required.

Although the present invention has been described with reference to a CELP speech coder it will be appreciated that a LTP delay derivation in accordance with the present invention will have much more widespread application.

From reading the present disclosure other modifications will be apparent to persons skilled in the art. Such modifications may involve other features which are already known in the design, manufacture and use of analogue signal coding arrangements and component parts thereof and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

I claim:

1. A coding apparatus for an analogue signal, comprising means for digitising the analogue signal, means for deriving a long term correlation coefficient for the analogue signal, means for deriving a number of short term coefficients for the analogue signal and means for deriving an excitation sequence which can be used to synthesise an approximation to the analogue signal, characterised in that the means for deriving a long term with fractional delay resolution comprises means for deriving a plurality of sums of products of samples of the digitised signal, means for interpolating the sums of products and means for determining a long term correlation coefficient from the interpolated plurality of sums of products of samples.

2. The apparatus coding arrangement as claimed in claim 1, characterised in that the means for determining the long term correlation coefficient derives a maximum from a plurality of interpolated sums of products divided by a term representing the energy of the digitised signal.

3. A coding arrangement as claimed in claim 1,.wherein the interpolating means comprises shift register means having a plurality of stages, an input of the shift register means being coupled to the summing means, multiplying means coupled to an output of each of the plurality of stages, means for supplying to each of the multiplying means a filter coefficient dependent on a predetermined fractional delay, combining means coupled to outputs of the multiplying means for summing the products produced by said multiplying means, and maximum value determining means coupled to an output of the combining means.

4. A prediction filtering apparatus comprising means for storing a plurality of samples, means for deriving a plurality of sums of products for the plurality of samples, means for interpolating the sums of products and means for determining a long term correlation coefficient with fractional delay resolution from the interpolated plurality of sums of products of samples.

5. The prediction filtering apparatus as claimed in claim 4, wherein the means for determining the long term correlation coefficient derives a maximum from a plurality of interpolated sums of products divided by a term representing the energy of the plurality of samples.

6. A prediction filtering arrangement as claimed in claim 4, wherein the interpolating means comprises shift register means having a plurality of stages, an input of the shift register means being coupled to the summing means, multiplying means coupled to an output of each of the plurality of stages, means for supplying to each of the multiplying means a filter coefficient dependent on a predetermined fractional delay, combining means coupled to outputs of the multiplying means for summing the products produced by said multiplying means, and maximum value determining means coupled to an output of the combining means.

7. A coding arrangement for an analogue speech signal, comprising means for digitizing the analogue speech signal, means for deriving a long term correlation coefficient for the analogue speech signal, means for deriving a plurality of short term coefficients for the analogue speech signal, means storing a plurality of code book sequences, long term filtering means coupled to said code book sequence storing means, short term filtering means coupled to the long term filtering means and means for comparing digitized speech samples with filtered code book sequences to derive an excitation sequence which can be used to resynthesize the analogue speech, wherein the means for deriving a long term coefficient comprises means for storing samples of the digitized signals, means for multiplying together two samples separated by an integer delay to provide a product, summing means for forming a sum of the products, interpolating means coupled to the summing means for interpolating the sums of products and means coupled to said interpolating means for determining the long term correlation coefficient with fractional delay resolution from the interpolated sums of products, which correlation coefficient is supplied to the long term filtering means.

8. A coding arrangement as claimed in claim 7, wherein the means for determining the long term coefficient means for deriving a maximum from a plurality of interpolated sums of products divided by a term representing the energy of the digitized signal.

9. A coding arrangement as claimed in claim 7, wherein the interpolating means comprises shift register means having a plurality of stages, an input of the shift register means being coupled to the summing means, multiplying means coupled to an output of each of the plurality of stages, means for supplying to each of the multiplying means a filter coefficient dependent on a predetermined fractional delay, combining means coupled to outputs of the multiplying means for summing the products produced by said multiplying means, and maximum value determining means coupled to an output of the combining means.

10. A method of coding an analogue signal, comprising digitizing the analogue signal, analyzing the the digitized analogue signal to derive a long term correlation coefficient for the analogue signal and a plurality of short term coefficients for the analogue signal, deriving an excitation sequence which can be used to synthesize an approximation to the analogue signal, and determining a long term correlation coefficient by deriving sums of products of samples of the digitized signal, interpolating the sums of products for fractional delays and determining a long term correlation coefficient with fractional delay resolution from the interpolated plurality sums of products of the samples.

11. A method as claimed in claim 10, wherein the long term correlation coefficient is determined by deriving a maximum from a plurality of interpolated sums of products divided by a term representative of the energy of the digitized signal.

12. A method as claimed in claim 10, wherein the analogue signal comprises a speech signal, the code book sequences are filtered in long term filtering means and the filtered output therefrom is filtered in short term filtering means to provide an output which is compared with digitized speech samples to obtain the excitation sequence which can be used to resynthesize the analogue speech.

* * * * *